US006349849B1

(12) United States Patent
Pehr

(10) Patent No.: US 6,349,849 B1
(45) Date of Patent: Feb. 26, 2002

(54) TISSUE DISPENSER

(76) Inventor: Harold T. Pehr, 12325 Horton, Shawnee Mission, KS (US) 66209

( * ) Notice: Subject to any disclaimer, the term of this patent is extended or adjusted under 35 U.S.C. 154(b) by 0 days.

(21) Appl. No.: 09/589,703

(22) Filed: Jun. 8, 2000

(51) Int. Cl.[7] ..... B65H 1/00

(52) U.S. Cl. ..... 221/33; 221/45; 221/47; 221/63

(58) Field of Search ..... 221/33, 34, 35, 221/45, 47, 48, 63; 206/233

(56) References Cited

U.S. PATENT DOCUMENTS

| | | | | |
|---|---|---|---|---|
| 2,118,380 A | | 5/1938 | Gresenz | |
| 2,651,409 A | | 9/1953 | Fay | |
| 3,012,692 A | | 12/1961 | Petersen | |
| 3,119,516 A | * | 1/1964 | Donovan | |
| 3,144,961 A | | 8/1964 | Phenner | |
| 3,239,097 A | * | 3/1966 | Bates et al. | |
| 4,616,767 A | | 10/1986 | Seido | |
| 4,623,074 A | | 11/1986 | Dearwester | |
| 5,143,249 A | * | 9/1992 | Saint Criq et al. | 221/46 X |
| 5,219,421 A | | 6/1993 | Tipping | |
| 5,332,117 A | | 7/1994 | Yadegar | |
| 5,520,308 A | | 5/1996 | Berg, Jr. et al. | |
| 5,535,887 A | | 7/1996 | Young et al. | |
| 5,540,354 A | | 7/1996 | Annand | |
| 5,622,281 A | * | 4/1997 | Annand | 221/48 |

* cited by examiner

*Primary Examiner*—David H. Bollinger
(74) *Attorney, Agent, or Firm*—John C. McMahon

(57) ABSTRACT

A tissue dispenser includes a box with a top wall and a front wall having a first slot and a second slot respectively. The slots are rectangular and parallel to each other. The slots are non-intersecting and each allow access to tissues in the box.

9 Claims, 1 Drawing Sheet

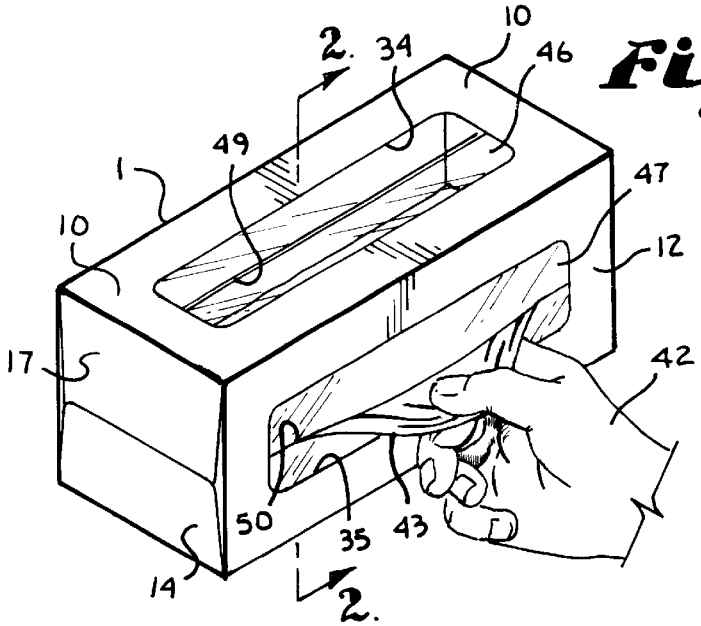
Fig.1.
Fig.2.
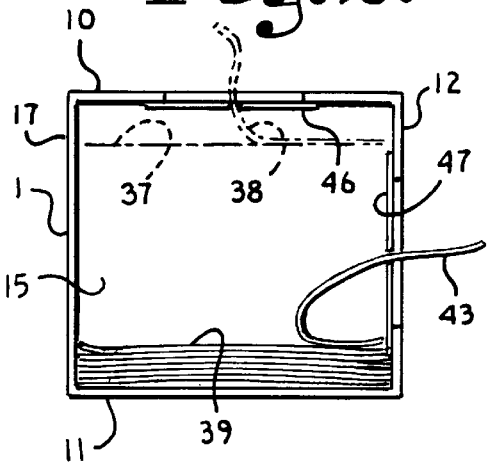
Fig.3.
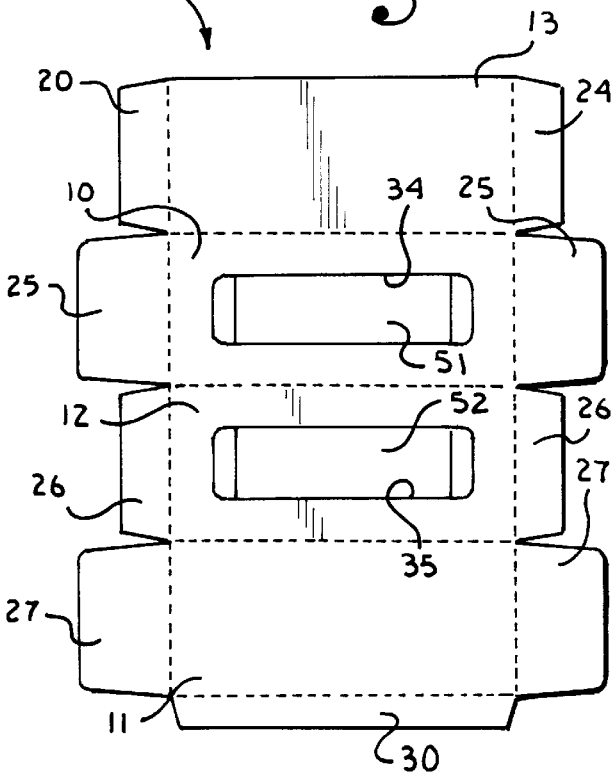

TISSUE DISPENSER

BACKGROUND OF THE INVENTION

The present invention is directed to a tissue dispenser that provides packaging for tissues, allows a first tissue to be withdrawn from the package and places subsequent tissues in a ready position for easy retrieval by a user.

There are many commercial manufacturers of paper tissues. These tissues are frequently sold in a container that has a withdrawal slot in the top of the container. The tissues are also folded in such a manner that as one is withdrawn from the opening in the top of the box, another tissue is placed in a raised position above the top of the box for ready access by the user.

A problem with such dispensers is that, as the supply of the tissues gets lower in the box, the exposed tissue frictionally grips less of the next tissue in a box and eventually loses the ability to draw a succeeding tissue out of the box. When this occurs, the next in line tissue collapses into the box and must be dug out by the user. This presents a problem since it is further down in the box than the initial tissue which is readily accessible, so the user must shove their hand through the opening in the top of the box to try to dig out a succeeding tissue. This may happen frequently before the box is empty and is especially troublesome with the larger boxes that hold 500 or more tissues.

The prior art has tried to overcome this problem with only a minor degree of success. In particular, some of the dispenser designs have included a second slot that communicates with the slot on the top of the box and extends across half of the top of the box and at least partly down the side of the box. While this in some ways allows the tissues to be fed to the side so as to reduce the likelihood that the succeeding tissue will simply fall back into the box, it presents other problems. For example, the opening in the top of the box is typically carefully designed to grip succeeding tissues and hold them upward so they are available to the user. Normally these boxes include a rectangular shaped slot or opening that is covered with a layer of thin plastic with a slit down the middle. The opening allows the user to reach in to grab either the first tissue or a later tissue, but at the same time the plastic tends to grip a tissue and hold it in a partly withdrawn state. In the boxes having a second side slot that intersects with the top slot, the primary slot construction is substantially disturbed so that the box loses its ability to hold the tissues in an upright position that are displayed through the primary slot.

Secondly, the side slot is generally perpendicular to the plane of the tissue so that the tissue ends up getting wadded up by the slot and the geometry of the side slot puts additional stress on the tissue which causes the tissue to often tear. This results in part of the tissue falling back in the box which is the problem the side slot is supposed to resolve.

Consequently, it is desirable to have a tissue dispensing box that allows the tissues to be originally withdrawn from the top of the box, but as the tissue layer drops, to allow tissues to be withdrawn from a second or subsequent slots from other areas of the box in an easy manner and in such a way that tissues are continuously fed through the second slot without the user having to dig into the box to get each tissue after the tissues drop beneath a certain level.

SUMMARY OF THE INVENTION

A container for tissues, especially a container in which the tissues are originally purchased, includes a set of walls joined together to form a rectangular box. An elongate first slot is located in a first of the walls, normally the top wall. The first slot is aligned such that it is parallel to the plane of the tissues, as tissues are withdrawn from the dispenser.

The dispenser includes a second slot in a second of the side walls. The second slot is elongate and also aligned to be parallel to the plane of the tissues as the tissues are withdrawn and to the first slot. The second slot is separate from the first slot and does not intersect therewith.

Both the first and second slots are preferably provided with a thin plastic cover which is slit down the middle so as to allow access to the dispenser through the slot, but to also frictionally grasp and hold a subsequent tissue in a ready position.

OBJECTS AND ADVANTAGES OF THE INVENTION

Therefore, the objects of the present invention are: to provide a dispenser for tissues that allows a user to withdraw tissues from a first dispensing opening, when the tissues are above a transition level within the dispenser and from a discreet second opening when tissues are below the transition level; to provide such a dispenser wherein the openings are separate from one another, elongate and parallel to one another; to provide such a dispenser wherein the openings are positioned in at least two different walls of the dispenser and are not contiguous with one another; to provide such a dispenser having a box which can be constructed generally from a single folded piece of material cut by a die from a sheet; to provide such a dispenser which allows tissues to be maintained at a ready position from a first slot, until tissues within the dispenser reach a certain level, and thereafter, the tissues may be accessed and maintained at a ready position from the second slot; to provide such a dispenser wherein the tissues are not substantially folded or wadded upon removal and are not easily torn due to pressure being exerted by the slot dispensing the tissue; to provide such a dispenser which is easy to manufacture, inexpensive to produce and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a tissue dispenser in accordance with the present invention, showing a tissue being dispensed from a side slot.

FIG. 2 is a cross-sectional view of the dispenser showing a tissue being dispensed from the side slot in solid lines and a tissue being dispensed from an upper slot in phantom lines, taken along line 2—2 of FIG. 1.

FIG. 3 is a top plan view of a cutout for making the tissue dispenser prior to folding and assembly thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms.

Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a tissue dispenser for sequentially dispensing a plurality of tissues contained therein.

The dispenser 1 comprises six walls including a top wall 10, a bottom wall 11, a front wall 12, a rear wall 13 and a pair of side walls 14 and 15 joined together to form a rectangular box 17.

The box 17 is formed from a sheet of cardboard or the like by die cutting a blank or planar sheet to create a foldable formed panel 20 shown in FIG. 3. The panel 20 is folded about creases indicated by dash lines with end flaps 24, 25, 26 and 27 on each side being joined together and sealed by glue or the like, so as to form the walls 10 through 15. An elongate flap 30 is also used to join the walls 11 and 13 together.

Located in the top wall 10 and front wall 12 are a pair of slots 34 and 35 respectively. Each of the slots 34 and 35 is elongate and located so that the tissues 5 can pass in a generally planar fashion through each of the slots 34 and 35. This keeps the tissues 5 from wadding and reduces likelihood of tear. The slots 34 and 35 extend almost the entire length of the box 17 and are of a generally uniform width which is normally the width necessary to insert a hand to remove a tissue 5 that is not exposed.

In particular, each of the slots 34 and 35 is wide enough to allow a user to push their hand down through the slot 34 and 35 into the box 17 to withdraw an initial tissue from the tissues 5 therefrom to start a continuous feed through either slot 34 or 35. The tissues 5 initially generally fill the box 17 and are normally initially at least at the level of the phantom line tissue level 37, shown in FIG. 2, and showing a first tissue 38. The tissues 5 are generally leafed together in such a manner that withdrawing one tissue 5 frictionally drags the next or subsequent tissue 5 and causes the next tissue to be pulled toward the same slot 34 or 35. After the first tissue 5 clears the slot 34 or 35, it disengages from the second tissue 5 leaving the later exposed and ready for use. As the level of tissues in the box 17 diminishes, such as is shown by the solid tissue level 39 in FIG. 2, an insufficient amount of each succeeding tissue 5 may be drawn through the top slot 34 to leave the succeeding tissue 5 extending from the box 17. In this situation, the user illustrated by the hand 42 in FIG. 1 reaches into the box 17 through the slot 35 and withdraws a first tissue 5, such as tissue 43, from the lower slot 35. In this manner the tissue 43 pulls a successive tissue from the tissue lower level 39 in a continuous stream and each successive tissue extends from the box 17 and becomes ready and exposed for grasping by the user.

Each of the slots 34 and 35 is generally rectangular with rounded corners. The slots 34 and 35 are covered internally by thin plastic layers 46 and 47 respectively which have central slits 49 and 50 respectively. The plastic layers 46 and 47 are glued to the panel 20. The plastic layers 46 and 47 tend to grip a tissue either 38 or 43 normally without tearing the tissue as it is withdrawn, but also are sufficiently elastic to allow a user to extend the user's hand 42 through the slits 49 and 50 to withdraw one of the tissues 5, in order to initiate a series of tissues 5 extending from the box 17 through either slot 34 or 35.

The slots 34 and 35 may also be initially protected by tear-away covers 51 and 52, which are seen in FIG. 3 but which are already torn away in FIGS. 1 and 2.

It is foreseen that the slots 34 and 35 may be in various different walls 10 through 15 in certain embodiments. For example, there could be a slot in the top wall 10 and in the bottom wall 11. In this manner tissues of a different type, for example, a different color could be withdrawn from opposite ends of the dispenser 1 by simply turning the dispenser 1 over.

Furthermore, it is foreseen that although the slot 35 is illustrated as a single opening, there could be multiple parallel openings along the side of a rather tall dispenser 1 to allow access at different levels within the dispenser 1. Furthermore, the slot 35 could be fairly wide having multiple tear-away covers to allow the user to tear away subsequent portions of a side cover to allow access to an ever lowering level of tissues 5 within the dispenser 1.

It is also foreseen that in certain instances the slots can be constructed in a different manner than described. For example, in lieu of the plastic layers, the slots may have closer opposed edges that are serrated so as to grasp the tissue and hold part of the tissue outside the box in readiness for subsequent use as it is drawn outwardly.

Finally, it is also foreseen that the present invention may be used in conjunction with other pliable or foldable sheet-type products that do not interleaf, such as trash bags and towels; however, while the invention is usable with these other type items it is noted that the invention is especially effective with items that interleaf together where the first to be removed draws at least part of a subsequent item through an opening due to friction between the two.

It is to be understood that while certain forms of the present invention have been illustrated and described herein, it is not to be limited to the specific forms or arrangement of parts described and shown.

What is claimed and desired to be secured by Letters Patent is as follows:

1. A dispenser for sheets of tissues or the like comprising:

a) a box sized and shaped to receive a stack of sheets and having a plurality of walls including a top wall and a front wall;

b) a first elongate slot in said top wall sized for withdrawing sheets; and c) a second elongate slot in said front wall sized for withdrawing sheets.

2. The dispenser according to claim 1 wherein:

a) said first and second slots are aligned to be parallel to each other.

3. The dispenser according to claim 1 wherein:

a) each of said first and second slots extend across most the length of respective walls.

4. The dispenser according to claim 1 wherein:

a) each of said slots are covered by a thin plastic layer with a central slot aligned to be generally parallel to tissues being withdrawn from said box.

5. The dispenser according to claim 4 wherein:

a) said slots are sized to allow a hand to be inserted therethrough.

6. The dispenser according to claim 1 wherein:

a) said slots are non-intersecting with one another.

7. The dispenser according to claim 1 wherein:

a) said slots are generally rectangular in shape and are much greater in length than in width.

8. The dispenser according to claim 7 wherein:

a) each of said slots is parallel to each other, non-intersecting with each other and positioned so as to be parallel to a plane associated with a sheet in said dispenser during use.

9. A dispenser for sheets of tissues and the like comprising:

a) a box having a top wall, a bottom wall, a front wall, a rear wall and a pair of side walls joined in a rectangular configuration and sized and shaped to receive a stack of sheets therein;

b) said top wall having a first tissue access slot therethrough;

c) said front wall having a second tissue access slot therethrough;

d) said first and second slots being non intersecting; said first and second slots being generally rectangular in shape and being longer than wide; said first and second slots being aligned parallel with each other and sized and shaped to be aligned parallel to a plane associated with the sheets in said box during use; and e) first and second thin plastic layers covering respective first and second slots; each of said layers having a central elongate slit aligned to allow access to a sheet in said box and to operably frictionally grasp and maintain a sheet in one of said slits in a ready position for use.

* * * * *